US005423343A

United States Patent [19]

Crouch

[11] Patent Number: 5,423,343

[45] Date of Patent: Jun. 13, 1995

[54] METHOD AND APPARATUS FOR MAKING SEWAGE PIPE CONNECTIONS

[76] Inventor: Ernie N. Crouch, 152 Rocky Step Rd., Scott, Depot, W. Va. 25560

[21] Appl. No.: 260,416

[22] Filed: Jun. 14, 1994

[51] Int. Cl.[6] ..... F16K 11/02

[52] U.S. Cl. ..... 137/15; 137/876; 251/294

[58] Field of Search ..... 137/15, 876, 625.47; 251/294

[56] References Cited

U.S. PATENT DOCUMENTS 4,225,110 9/1980 Akkerman et al. ..... 251/294 X
4,264,244 4/1981 Steele ..... 137/876 X
4,522,233 6/1985 Mujadad ..... 137/625.47

*Primary Examiner*—John C. Fox
*Attorney, Agent, or Firm*—George J. Neilan

[57] ABSTRACT

In a sewage piping system that includes a new sewer main line that crosses existing lateral sewer lines, a rotary valve is installed at the intersection of the main line and each lateral line. Ditches containing the lines may be backfilled. Before completion and testing of the new main line; the valve permits the existing lateral line to be used as before. Thereafter the valve is rotated from above ground to connect the lateral line to the new main line and to seal off the unused portion of the lateral line.

12 Claims, 4 Drawing Sheets

METHOD AND APPARATUS FOR MAKING SEWAGE PIPE CONNECTIONS

This invention relates to a piping system and valve assembly for connecting existing sewer supply pipes to a new sanitary sewer line. The valve assembly may be actuated from above ground.

BACKGROUND OF THE INVENTION

At the present time, during installation of a new sanitary sewer main, existing branch lines are crossed and/or broken. It is intended that these branch lines will eventually be connected to the sewer main. However, because of necessity to test the new main line after it is installed, connections cannot be made at that time. Accordingly, a "T" or other connector may be installed in the main line, and the branch lines and the main line are buried. Subsequently, after testing of the new system, the lines are unearthed and the laterals are tied into the new sewer system. Thereafter, the lines are reburied.

SUMMARY OF THE INVENTION

A principal object of the present invention is to avoid, in the connection of a new sewage main to existing lateral lines, having to go back and uncover the lines to make a connection to the main after testing. In accordance with the invention, when installing a new main, a novel valve assembly is installed at the point of intersection with an existing lateral line. The valve assembly permits the existing lateral line to continue to be used as before. The various lines are then buried.

After testing of the new sewage main line, the valve assembly is manipulated from above ground without excavation to connect the lateral to the new main line and block off the now unneeded old discharge line. A cable extends from the valve assembly to above ground. Manipulation of the cable rotates the valve to a position enabling flow from the lateral line to the new main line, while at the same time blocking off the old discharge line. The valve assembly includes means forming an airtight seal to permit testing of the new sewer main prior to use.

This approach results in considerable cost savings, since it is not necessary to return with equipment to uncover the pipes, and the valve assembly may be rotated easily by one person in a short period of time.

DETAILED DESCRIPTION OF THE INVENTION

Figure 1:
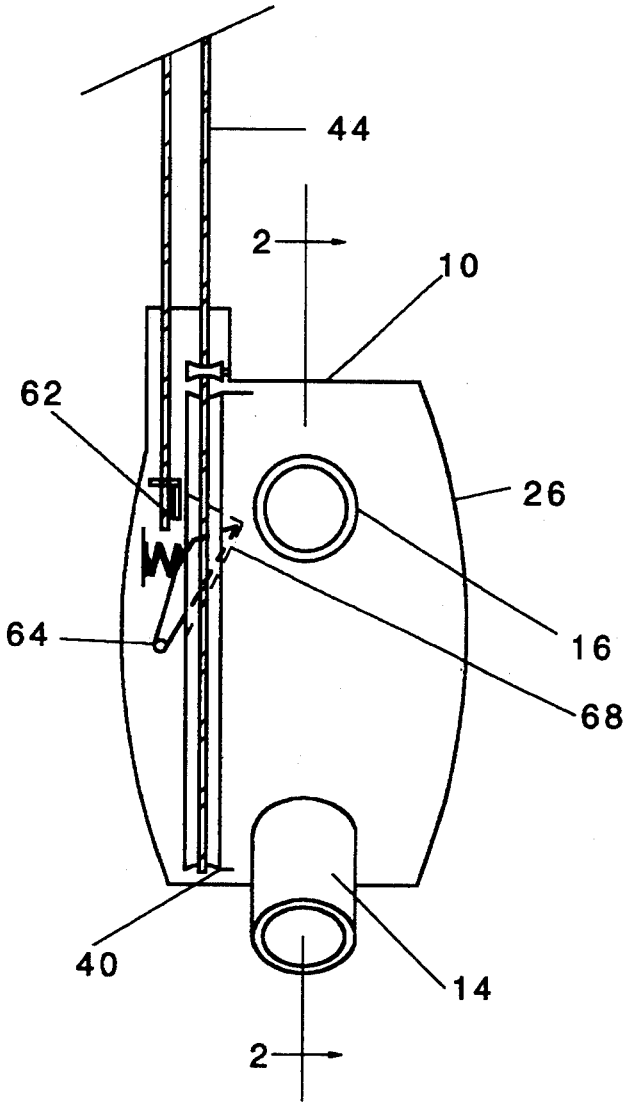
FIG. 1 is an elevational view partially in cross section of a presently preferred embodiment of the invention.

Referring to the drawings, reference numeral 10 generally designates a valve housing in accordance with a presently preferred embodiment of the invention. Valve housing 10 has an inlet 12 and first and second outlets 14 and 16. The valve housing is connected at inlet 12 to the end of an existing branch sewer supply pipe 18. Outlet

16 is attached to a discharge pipe 20 which is a portion of the existing sewer line which discharges to an old sewer main or the like (not shown). The first outlet 14 connects to a "T" 22 of a newly installed sewer main 24.

Figure 2:
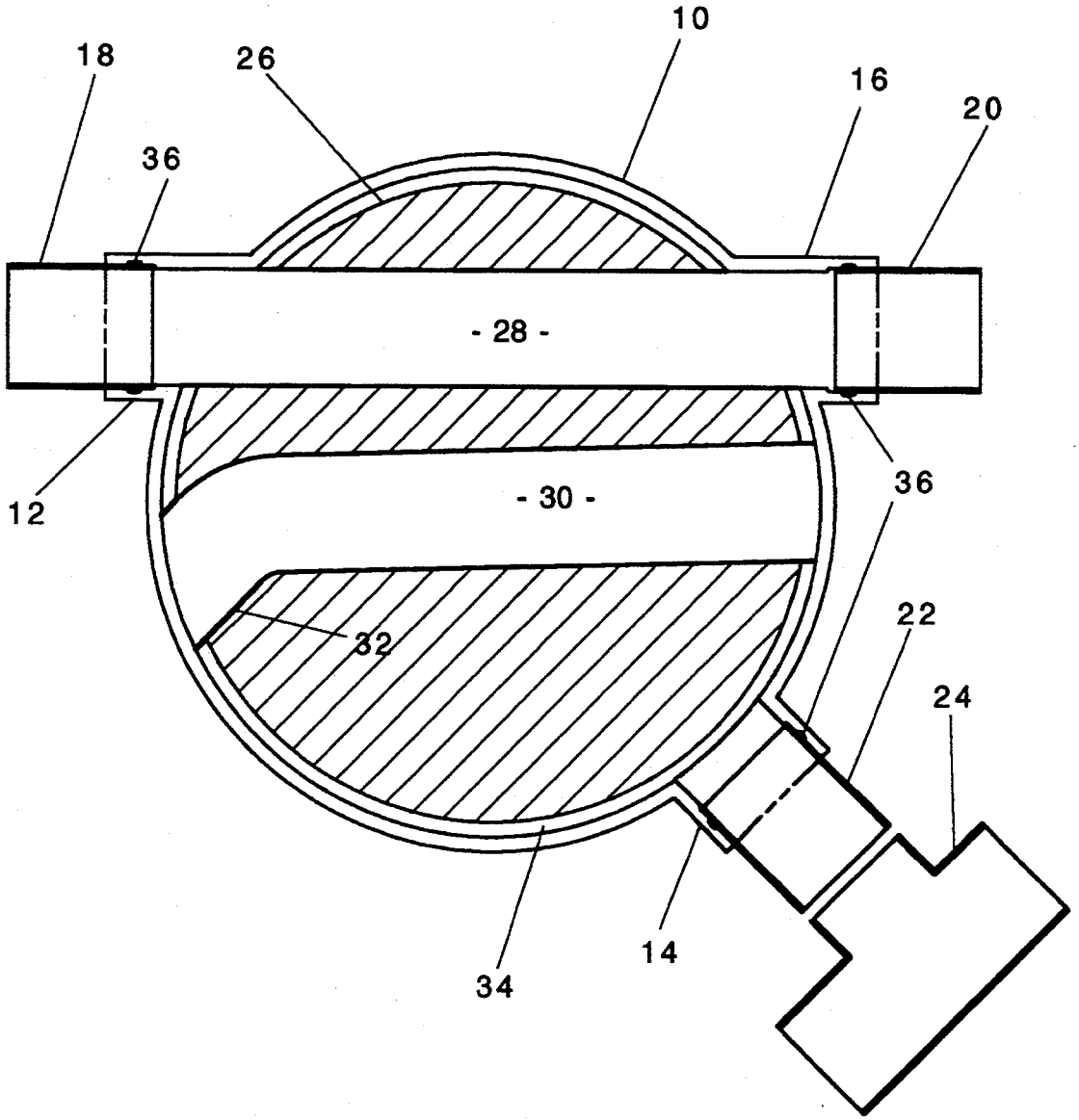
FIG. 2 is a vertical cross-sectional view taken substantially on line 2—2 of FIG. 1.

As shown in FIG. 2, a rotatable valve 26 is disposed within valve housing 10. Valve 26 has a first flow passage 28 which, as illustrated, extends between inlet 12 and outlet 16. The diameter of passage 28 is substantially the same as the inside diameter of pipes 18 and 20. Thus, in the position illustrated, sewage may flow from branch sewer supply pipe 18 through passageway 28, unimpeded to the discharge pipe 20.

The rotatable valve 26 has a second flow passage 30 with a short inlet end 32, that is at about a 45-degree angle to the remainder of passage 30. When passage 30 is in this orientation, a self-lubricating airtight seal 34 seals off the outlet 14. Thus, installation of the new sewer main 24 may continue without interrupting sewage flow through previously installed pipes 18 and 20. When installation of sewer main 24 is completed, it may be pressure tested since it is sealed off from the valve housing by seal 34.

Conventional o-ring gaskets or seals 36 are provided in inlet 12 and outlets 14 and 16 to prevent leakage.

After sewer main 24 has been tested and is ready for use, valve 26 is rotated, in a manner to be described hereinafter, so that flow passage 30 is rotated to a position in which its inlet end 32 is positioned at inlet 12 and the other end of flow passage 30 is positioned at outlet 14. Accordingly, sewage will now flow from branch sewer supply pipe 18 through passage 30, and "T" 22 to sewer main 24.

Figure 3:
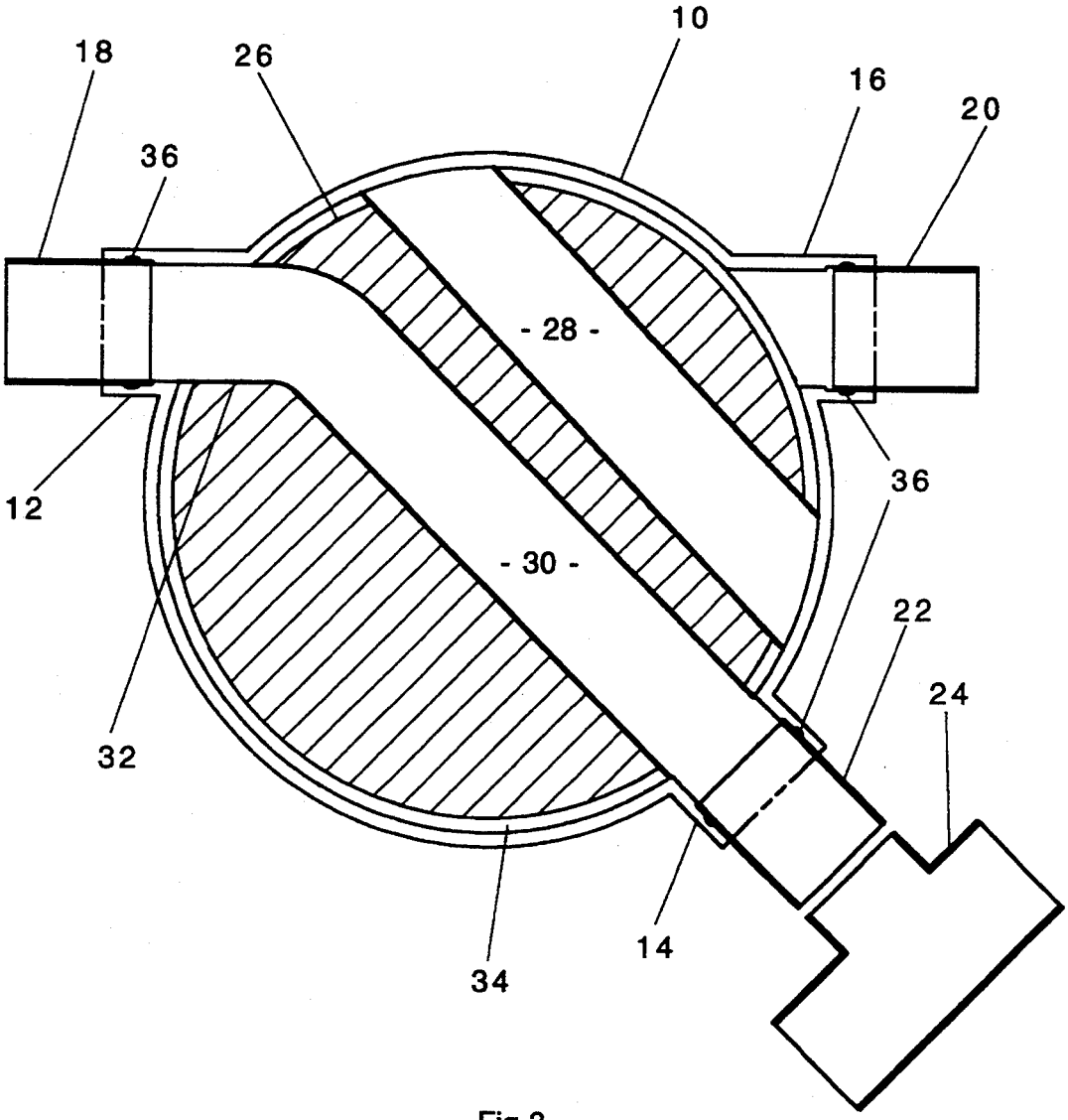
FIG. 3 is a view similar to FIG. 2 but with the valve rotated to connect to a different outlet.

Referring to FIGS. 1 and 3, there is a peripheral groove 40 in the exterior circumference of valve 26. A pair of control cables 42,44 are positioned in groove 40 with their free ends secured to the valve body by bolts 46. The control cables extend upward through a port 48 in valve housing 10 into a flexible conduit 50 which extends to an aboveground housing 52.

Figure 4:
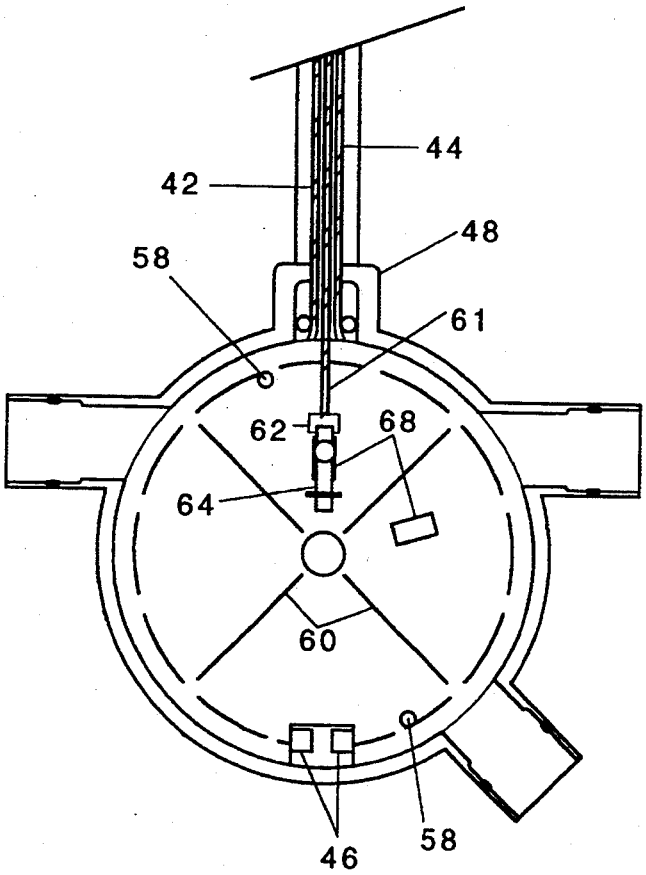
FIG. 4 is an end view of the apparatus of FIG. 1.

Referring to FIG. 4, the upper ends of control cables 42 and 44 are connected to a support 54. All threads 55 and 56 and pairs of locking nuts 57 at the ends of the control cables and permit limited movement. Rotation stops 58 on the interior wall of housing 10 limit the amount of rotation of the valve to properly align the flow passages by resting against properly positioned ribs 60 on valve 26.

Housing 52 may be located on the surface of the ground, or partially or fully disposed just beneath the surface of the ground.

When it is time to connect the pipe 18 to the new sewer main 24, locking nuts on all threads 55 and 56 held by support 54 are loosened. Nuts on all threads 55 are then tightened pulling on cable 42 causing valve 26 to rotate clockwise. This changes the orientation of the valve from a first position, in which the first flow passage 28 is operative, to a second position in which the second flow passage 30 connects the inlet 12 and outlet 14. Rotation stop 58 stops rotation of valve 26 when in the proper alignment. At this time, the self-lubricating seal 34 on the valve body permanently closes off outlet 16, thus sealing off the now abandoned section of the old line-discharge pipe 20.

A locking system is provided to lock the valve in its final position. A valve-locking system includes a locking cable 61, inside flexible conduit 50, which has at its lower end a latch 62 which holds a spring-loaded arm 64 in a compressed state. Arm 64 and latch 62 are attached to the interior wall of housing 10.

Figure 5:
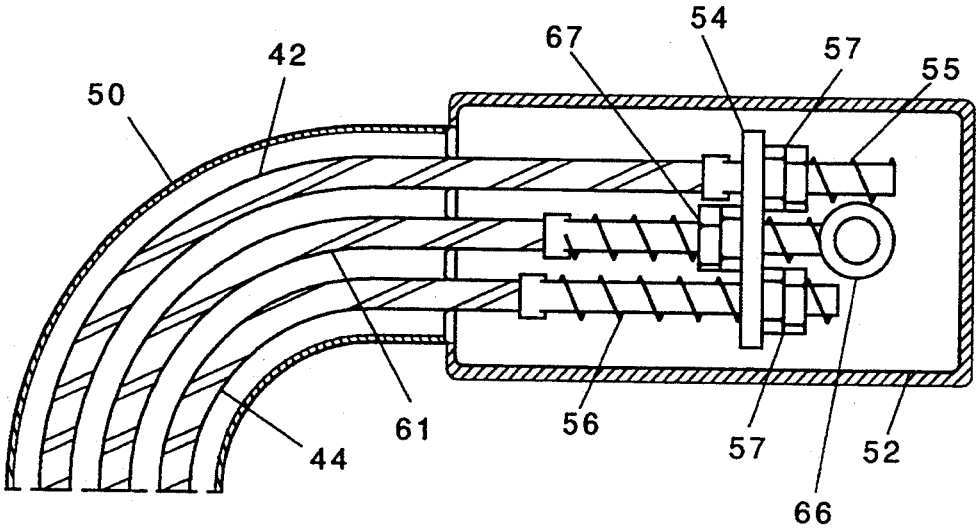
FIG. 5 is a view partially in vertical cross-section of the cable adjustment means for adjusting the valve assembly.

As shown in FIG. 5, the upper end of locking cable 61 is connected to support 54 and includes an eyelet end 66. By loosening lock nuts 67 and pulling on eyelet end 66 of locking cable 61, the locking cable elevated causing latch 62 to release spring-loaded arm 64 which springs outwardly into an alignment groove 68 in valve 26 thereby locking valve 26 in position and preventing further rotation of the valve.

In the event that the orientation of the system was such that the valve 26 should be rotated in a counterclockwise direction; then all threads 56 would be tightened pulling cable 44 and causing valve 26 to rotate counterclockwise until rotation is stopped by abutting against the respective stop 58. When the valve 26 is in its final position; control cables 42 and 44, locking cable 61, and conduit 50 may be severed approximately at ground level. Their severed upper ends and housing 52 are discarded and the remainder of the cables and conduit are buried.

From the foregoing description, it should be apparent that the system of the invention provides substantial economies. The rotating valve enables permanent connection of existing lateral lines to the new system during initial installation. The system also maintains proper function of existing lines until the new system is fully operational and airtight seals enable testing of the new system. The cable system which extends above ground enables a switchover of the existing lateral lines to the new sewer main without reexcavation.

I claim:

1. A sewage piping system comprising
a sewer main,
a branch sewer supply pipe,
a valve housing having an inlet and a pair of outlets, said inlet being connected to said sewer supply pipe, one of said outlets being connected to said sewer main,
a discharge pipe for temporary use connected to the second of said outlets,
valve means in said valve housing movable from a first position enabling flow from said inlet to said second outlet to a second position enabling flow from said inlet to said one outlet, and
control means external of said valve housing to move said valve means from said first position to said second position.

2. Apparatus according to claim 1, wherein said valve means includes a rotatable valve body having a pair of flow passages therein, one of the flow passages being operative in the first position of said valve means and the other of the flow passages being operative in the second position of said valve means.

3. Apparatus according to claim 2, further comprising means forming an air tight seal at said one outlet when said valve means is in the first position.

4. Apparatus according to claim 2, wherein said control means includes a cable extending through said valve housing and having an end attached to said rotatable valve body.

5. Apparatus according to claim 4, further comprising stop means attached to said rotatable valve body to limit rotation of said rotatable valve body.

6. Apparatus according to claim 4, further comprising locking means to lock said valve means in the second position.

7. Apparatus according to claim 6, wherein said locking means include a cable extending externally of said valve housing.

8. Apparatus according to claim 2, wherein said rotatable valve body is provided with a peripheral groove, and said control means includes a cable extending through said valve housing and positioned in said peripheral groove.

9. Apparatus according to claim 2, wherin an upper end of said control means is accessible from above ground with said valve housing being buried below ground.

10. A method for installing a buried sewerage system comprising
installing a sewer main in a ditch,
connecting a valve to a branch sewer supply line, said valve having a first position connecting said supply line to a temporary discharge line and having a second position connecting said supply line to said sewer main,
burying the system in the ground, and
thereafter moving said valve from said first position to said second position.

11. A method according to claim 10, further comprising
running a control cable for said valve from said valve to the surface of the ground prior to the burying step.

12. A method according to claim 10, further comprising rotating said valve to move it from said first position to said second position.

* * * * *